US006799834B2

(12) United States Patent
Fujii et al.

(10) Patent No.: US 6,799,834 B2
(45) Date of Patent: Oct. 5, 2004

(54) METHOD FOR MANUFACTURING AN ELECTROSTATIC ACTUATOR

(75) Inventors: Masahiro Fujii, Shiojiri (JP); Hiroyuki Maruyama, Nagano-ken (JP); Kazuhiko Sato, Hata-machi (JP); Koji Kitahara, Ina (JP); Tomohiro Makigaki, Azusagawa (JP); Shigeo Nojima, Suwa (JP); Taro Takekoshi, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 5 days.

(21) Appl. No.: 10/215,229

(22) Filed: Aug. 8, 2002

(65) Prior Publication Data

US 2003/0003618 A1 Jan. 2, 2003

Related U.S. Application Data

(62) Division of application No. 09/424,163, filed on Feb. 29, 2000, now Pat. No. 6,450,625.

(30) Foreign Application Priority Data

Mar. 18, 1998 (JP) ..... 10-69105

(51) Int. Cl.[7] ..... B41J 2/04
(52) U.S. Cl. ..... 347/54
(58) Field of Search ..... 347/70, 67–69, 347/65, 54–55, 71–72, 20; 29/25.35; 310/342, 311, 333; 400/124.16; 438/21, 718; 216/2, 27

(56) References Cited

U.S. PATENT DOCUMENTS

| | | | | |
|---|---|---|---|---|
| 5,684,519 A | | 11/1997 | Matoba et al. | 347/54 |
| 5,923,352 A | | 7/1999 | Kikuchi et al. | 347/70 |
| 6,234,607 B1 | * | 5/2001 | Sakai et al. | 347/54 |
| 6,328,430 B1 | | 12/2001 | Ahn et al. | 347/65 |
| 6,345,883 B1 | | 2/2002 | Shin et al. | 347/54 |
| 6,361,154 B1 | | 3/2002 | Watanabe et al. | 347/70 |
| 6,371,598 B1 | | 4/2002 | Fujii et al. | 347/54 |
| 6,371,599 B1 | | 4/2002 | Hotomi et al. | 347/54 |
| 6,568,794 B2 | * | 5/2003 | Yamanaka et al. | 347/54 |

FOREIGN PATENT DOCUMENTS

| | | |
|---|---|---|
| JP | 4-284255 | 10/1992 |
| JP | 6-55732 | 3/1994 |
| JP | 9-314837 | 12/1997 |
| JP | 10-16210 | 1/1998 |
| JP | 10-44407 | 2/1998 |

* cited by examiner

*Primary Examiner*—K. Feggins
(74) *Attorney, Agent, or Firm*—Mark P. Watson

(57) ABSTRACT

A method for manufacturing an electrostatic actuator comprises a vibrating plate, an electrode plate facing the vibrating plate, and a vibrating chamber formed between the electrode plate and the vibrating plate, wherein the vibrating plate is displaced by electrostatic force, by applying voltage between the vibrating plate and the electrode plate, the method comprises: a process for forming a pressure compensating chamber communicating with the vibrating chamber; a process for forming a displacement plate at a portion of the pressure compensating chamber, displaceable according to external atmospheric pressure, into a warped form curved so as to protrude in a direction away from the facing inner wall of the pressure compensating chamber; and a process for shutting off and sealing the pressure compensating chamber from the external atmosphere, along with the vibrating chamber.

6 Claims, 20 Drawing Sheets

First Embodiment

First Embodiment

Second Embodiment

Third Embodiment

Fifth Embodiment

METHOD FOR MANUFACTURING AN ELECTROSTATIC ACTUATOR

This application is a divisional of application Ser. No. 09/424,163, filed Feb. 29, 2000, now U.S. Pat. No. 6,450, 625 the contents of which are incorporated herein by reference.

TECHNICAL FIELD

The present invention relates to an electrostatic actuator which generates pressure by displacing a vibrating plate with electrostatic force, and to a manufacturing method therefor, and also relates to a liquid spraying or discharging device, such as an ink-jet head, for discharging droplets, using the same. More particularly, the present invention relates to an electrostatic liquid spraying or discharging device such as an ink-jet head printer, for example, capable of continually performing proper droplet discharging action regardless of external atmospheric pressure fluctuations.

BACKGROUND ART

The background art will now be described with an ink-jet printer as an example of an electrostatic liquid discharging device. An ink-jet printer having an electrostatic ink-jet head is disclosed in Japanese Unexamined Patent Application Publication No. 6-55732, for example. With this type of ink-jet head, ink within a pressure chamber is discharged from an ink nozzle by vibrating a vibrating plate forming a portion of the pressure chamber wherein ink liquid is stored, by electrostatic force. Accordingly, changes in the external atmospheric pressure alter the discharge properties of the ink droplets, which may cause a problem in that the desired ink droplets may not be discharged.

That is, with an electrostatic ink-jet head, a vibrating plate defining a portion of the pressure chamber faces an electrode plate across a narrow gap, and the vibrating plate is vibrated by electrostatic force by applying a driving voltage therebetween. The gap between the vibrating plate and the electrode plate is extremely narrow, around 1 to 2 microns, so the space between the vibrating plate and the electrode plate is sealed to form a sealed chamber, so that the vibration of the vibrating plate is not inhibited by intrusion of dust and the like therebetween.

In the event that the external atmospheric pressure fluctuates, the vibrating plate, partitioning off the pressure chamber and the sealed chamber, is displaced in a direction such that the pressure within the sealed chamber matches that of the external atmospheric pressure. Consequently, even when voltage has not been applied, the vibrating plate is in a state of already having been displaced. Thus, in the event that the external atmospheric pressure fluctuates, the vibrating properties of the vibrating plate change even when the same driving voltage is applied, and the discharging properties of the ink droplets (the amount of ink droplets per discharge and the discharging speed of the ink droplets) change.

Now, ink-jet printers having a bubble-jet ink-jet head disclosed in Japanese Unexamined Patent Application Publication No. 4-284255 are known. This Unexamined Patent Application Publication discloses a method for performing continuously stable ink droplet discharging action regardless of fluctuations in the external atmospheric pressure, by detecting the ambient atmospheric pressure and changing the voltage waveform applied to the electro-thermal converting member, that is to say, the driving voltage waveform of the ink-jet head, according to the external atmospheric pressure.

This method is effective for ink-jet heads according to the bubble-jet method wherein ink liquid within the pressure chamber is heated and caused to bubble, but is seldom advantageous when applied to electrostatic ink-jet heads. Particularly, in environments such as high elevations where the atmospheric pressure differs markedly from normal, merely adjusting the driving voltage waveform for driving the vibrating plate may not be sufficient to facilitate appropriate droplet discharge.

Now, electrostatic actuators may be applied to other devices besides the ink-jet printer given here as an example, such as fuel injection devices for internal combustion engines, atomizers for spraying liquids such as perfume, and micro-pumps, but with these devices as well, it is thought that the droplet discharge properties fluctuate according to fluctuation of external atmospheric pressure.

OBJECTS OF THE INVENTION

It is an object of the present invention to provide an electrostatic actuator capable of reliably generating desired pressure unaffected by fluctuations of the external atmospheric pressure, and an electrostatic liquid spraying device capable of discharging droplets in an appropriate manner.

SUMMARY OF THE INVENTION

In order to achieve the above objects, the electrostatic actuator according to the present invention comprises a vibrating plate, an electrode plate facing the vibrating plate, and a sealed chamber formed between the electrode plate and the vibrating plate; wherein the vibrating plate is displaced through electrostatic force by applying voltage between the vibrating plate and the electrode plate; the electrostatic actuator having a pressure compensator for decreasing the pressure difference between the internal pressure in the sealed chamber and the external pressure.

The pressure compensator employed may comprise a pressure compensating chamber communicating with the sealed chamber, and may be capable of increasing/decreasing its volume according to external atmospheric pressure.

In this case, the entire pressure compensating chamber might be formed of an expanding/contracting material, or a portion of the pressure compensating chamber may be defined by a displacement plate displaceable in the direction perpendicular to its plane (horizontal plane) according to external atmospheric pressure.

Now, the displacement plate is only slightly separated from the facing wall of the pressure compensating chamber, so in the event that the external atmospheric pressure is high, the displacement plate may be displaced and come into contact with the opposing inner wall, thereby inhibiting pressure compensating functions. Also, in the event that the displacement plate is towards the facing wall the compliance thereof decreases, which may also result in the inhibition of pressure compensating functions. Accordingly, the displacement plate is preferably curved in a form so as to protrude in a direction away from the facing inner wall of the pressure compensating chamber.

Next, an arrangement may be used wherein a displacement plate displaceable in the outwards direction of the plane is positioned as a portion of the horizontal pressure compensating chamber, wherein the displacement plate and electrode plate are positioned facing one another, so that the displacement plate is displaced according to changes in external atmospheric pressure, by electrostatic force.

Alternately, the pressure compensator may comprise a heat-generating member capable of at least heating gas sealed in the sealed chamber, instead of the pressure compensating chamber. Heating the sealed gas with the heat-generating member raises the internal pressure thereof, so the pressure difference with the external atmospheric pressure can be relieved.

A preferable material used for configuring the electrostatic actuator is a semiconductor substrate which can be worked with precision. Accordingly, for example, doping a semiconductor substrate with boron, etching the semiconductor substrate, and using the boron doped layer as a displacement plate, allows a displacement plate with desirable properties (compliance) to be obtained. Also, in order to form the electrostatic actuator in a compact size, the vibrating plate and displacement plate are preferably sectioned and formed using a common semiconductor substrate.

Also, the electrostatic liquid spraying or discharging device according to the present invention uses the pressure of the above electrostatic actuator having the pressure compensating functions, as the pressure generating source for discharging droplets. That is, the electrostatic liquid spraying or discharging device comprises a nozzle for discharging droplets, and a pressure chamber communicating with the nozzle and also holding liquid, wherein a vibrating plate provided in a portion of the pressure chamber is vibrated by the above-described electrostatic actuator, thereby providing the liquid in the pressure chamber with pressure fluctuation for discharging droplets.

Common ink-jet heads serving as liquid discharging devices are provided with multiple ink nozzles, with pressure chambers provided corresponding to each ink nozzle, and with a common ink chamber (common liquid chamber) for supplying ink liquid to the pressure chambers provided.

Now, a diaphragm displaceable in the outwards direction of the horizontal plane is in some cases formed at the common ink chamber, so that pressure fluctuations in each of the communicating pressure chambers are not transmitted to the side of the neighboring pressure chamber. In the case of applying the present invention to such an ink-jet head, the diaphragm may also serve as the displacement plate. Also, in order to form the device or a portion thereof (the ink-jet head) in a compact size, the pressure chamber, the common ink chamber, and the pressure compensating chamber are preferably sectioned and formed using a common semiconductor substrate.

In particular, with a liquid spraying or discharging device comprising an electrostatic actuator of a configuration wherein the displacement plate of the pressure compensating chamber is displaced by electrostatic force, the configuration may have an external atmospheric pressure detector for detecting external atmospheric pressure, and a controller for driving the displacement plate according to the detected external atmospheric pressure.

Also, with a liquid spraying or discharging device having an electrostatic actuator comprising the heat-generating member, the configuration may have an external atmospheric pressure detector for detecting external atmospheric pressure, and a controller for driving the heat-generating member according to the detected external atmospheric pressure.

Now, the external atmospheric pressure detector may be of a configuration comprising an electrostatic capacity detector for detecting the electrostatic capacity between the vibrating plate and the electrode plate, and thereby estimating the external atmospheric pressure based on the detected electrostatic capacity.

The method for manufacturing the electrostatic actuator according to the present invention is a method for manufacturing an electrostatic actuator comprising a vibrating plate, an electrode plate facing the vibrating plate, and a vibrating chamber formed between the electrode plate and the vibrating plate, wherein the vibrating plate is displaced by electrostatic force, by applying voltage across the vibrating plate and the electrode plate, the method comprising: a process for forming a pressure compensating chamber communicating with the vibrating chamber; a process for forming a displacement plate at a portion of the pressure compensating chamber, displaceable according to external atmospheric pressure, into a form curved so as to protrude in a direction away from the facing inner wall of the pressure compensating chamber; and a process for shutting off and sealing the pressure compensating chamber from the external atmosphere, along with the vibrating chamber. Furthermore, the air pressure for sealing the pressure compensating chamber may be adjusted. Accordingly, the initial curvature of the displacement plate is adjusted, and a displacement plate with desired compliance properties can be obtained.

DETAILED DESCRIPTION OF THE INVENTION

The embodiments of the present invention will be described below with reference to the drawings. Now, the embodiments are described with the example of an ink-jet printer, but the present invention is applicable to liquid discharging devices other than ink-jet printers, such as devices for spraying fuel, perfume, or the like, devices for applying pressure to liquid medicine or the like, and so forth, as long as the device uses an electrostatic actuator.

Also, the embodiments are given for illustrative purposes. Accordingly, one skilled in this art will be able to replace the various components of the examples with other equivalents, and such embodiments are also contained within the scope of the present invention.

First Embodiment

FIG. 1 through FIG. 6 illustrate an ink-jet printer mounted with an ink-jet head according to the first embodiment of the present invention.

Overview of the Mechanism System

Figure 1:
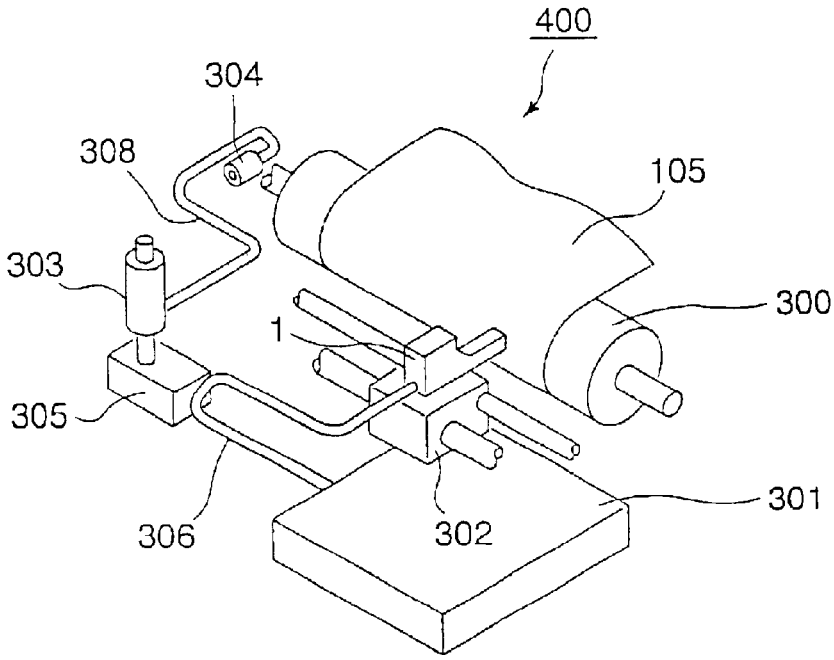
FIG. 1 is a schematic configuration diagram illustrating an overview of an ink-jet printer mechanism in which the present invention is applicable.

FIG. 1 is a schematic configuration diagram illustrating the overall configuration of the mechanism system of an ink-jet printer in which the present invention is applied. The mechanism system of the ink-jet printer 400 according to the present example is a common arrangement, having a platen roller 300 serving as a component of a transporting means for transporting recording paper 105, an ink-jet head 1 facing the platen roller 300, a carriage 302 for reciprocally moving the ink-jet head 1 in the line direction (scanning direction) which is the axial direction of the platen roller 300, and an ink tank 301 for supplying ink to the ink-jet head 1 via an ink tube 306.

Reference numeral 303 denotes a pump, which is used in the event that a state of defective ink discharge occurs at the ink-jet head 1, for suctioning the ink via the cap 304 and waste ink tube 308 to the waste ink pool 305.

Ink-jet Head

Figure 2:
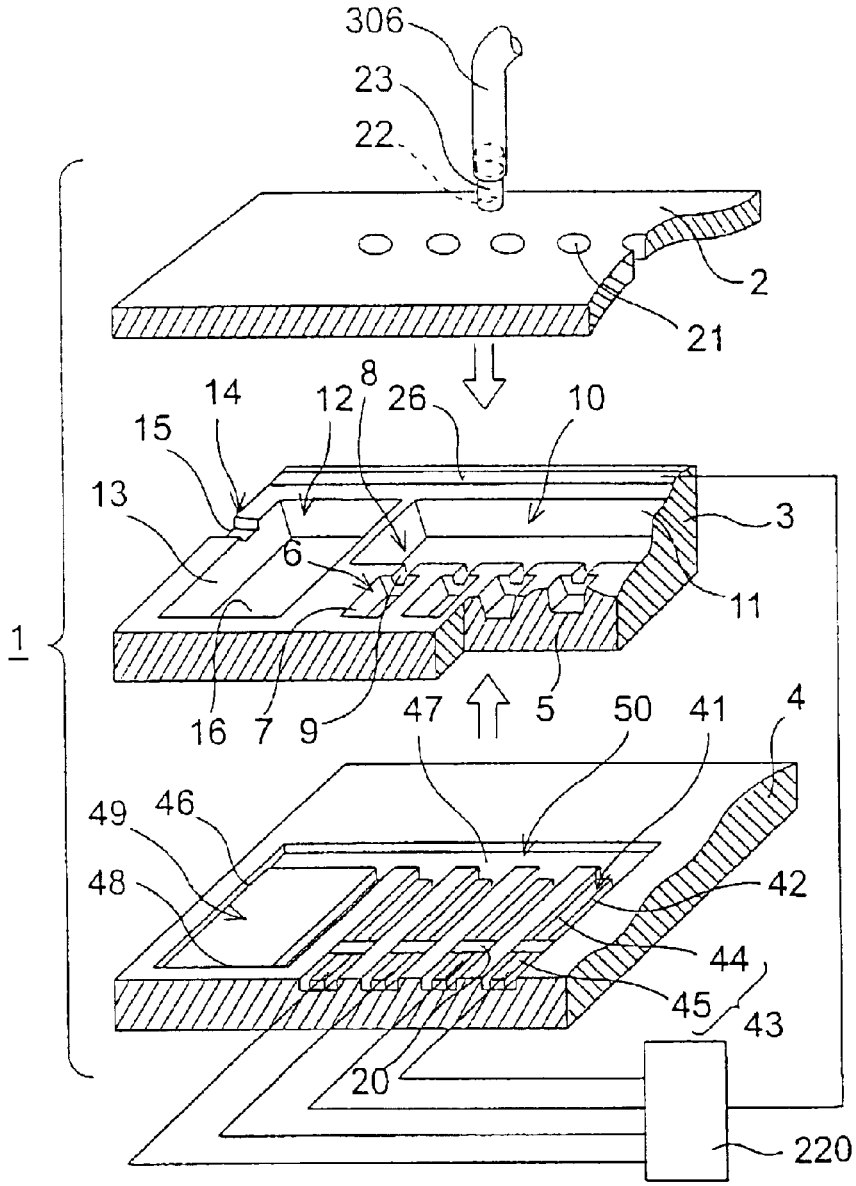
FIG. 2 is a perspective view along the line II—II of FIG. 5 illustrating the disassembled ink-jet head of an ink-jet printer relating to a first embodiment of the present invention.
Figure 3:
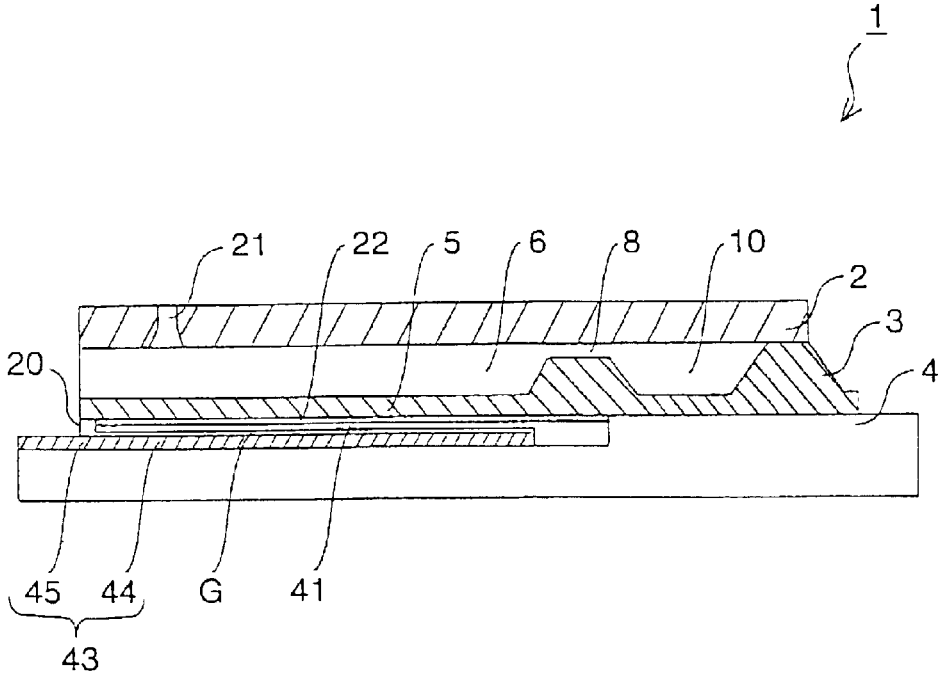
FIG. 3 is a schematic longitudinal cross-sectional diagram of the ink-jet head shown in FIG. 2.
Figure 4:
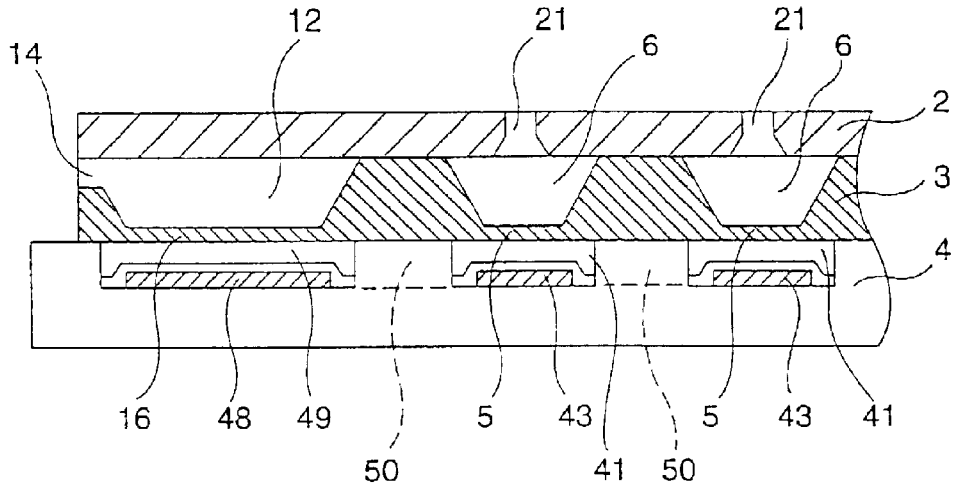
FIG. 4 is a schematic transverse cross-sectional diagram along the line IV—IV of FIG. 5 of the ink-jet head shown in FIG. 2.
Figure 5:
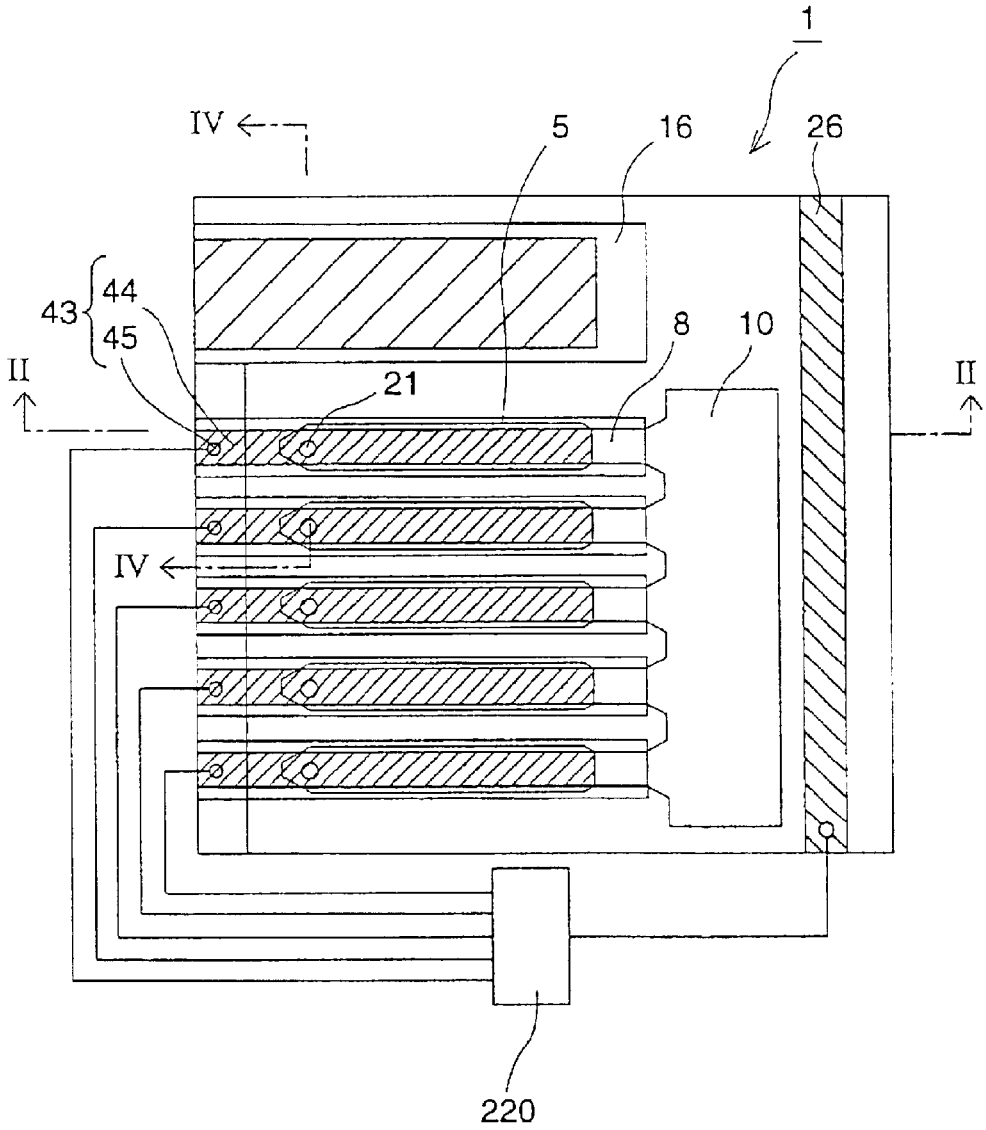
FIG. 5 is an explanatory diagram illustrating the electrode position of the ink-jet head shown in FIG. 2.

FIG. 2 is a perspective view of a disassembled ink-jet head of the present example; FIG. 3 is a schematic longitudinal cross-sectional diagram of the assembled ink-jet head; FIG. 4 is a schematic transverse cross-sectional diagram thereof, and FIG. 5 is an explanatory diagram illustrating the electrode position thereof.

As is shown in these Figures, the ink-jet head 1 is a face type electrostatic ink-jet head wherein ink droplets are discharged from ink nozzles provided on the upper face of a substrate. This ink-jet head 1 is formed of a three-layer structure of an upper nozzle plate 2 and a lower glass substrate 4 having a cavity plate 3 introduced therebetween.

The cavity plate 3 is a silicone substrate for example, with the surface of this plate being formed by etching a recess 7 comprising the compression chamber 6 wherein the base plate functions as the vibrating plate 5, a fine groove 9 forming the ink supplying opening 8 provided on the rear portion of the recess 7, and a recess 11 comprising the common ink chamber 10 for supplying ink to each of the pressure chambers 6.

In addition, a recess 13 comprising an atmospheric pressure or atmosphere communicating chamber 12, communicating with the atmosphere, is formed by etching at a position adjacent to the pressure chamber recess 7 positioned at the far edge. The base plate portion of this atmospheric pressure chamber 12 functions as the displacement plate 16 which is displaced according to changes in the external atmospheric pressure. In the present embodiment, the compliance of this displacement plate 16 is set so as to be 10,000 times or greater than the total sum of the compliance of the vibrating plates 5.

Also, a groove 15 is also formed comprising an external atmosphere communicating hole 14 for the atmosphere chamber 12 to communicate externally. The lower plane of the cavity plate 3 is smoothed by mirror polishing.

The nozzle plate 2 joined to the upper side of the cavity plate 3 is a silicone substrate for example, the same as the cavity plate 3. On the nozzle plate 2, plural ink nozzles 21 communicating with the pressure chambers 6 are formed at the portion defining the upper plate of the pressure chambers 6. Also, an ink supplying hole 22 for supplying ink to the common ink chamber 10 is formed on the portion defining the upper plane of the common ink chamber 10.

Joining the nozzle plate 2 to the cavity plate 3 causes the above recess 7, 11, 13, and fine grooves 9 and 15 to be covered, and the pressure chambers 6, ink supplying openings 8, common ink chamber 10, atmosphere communicating chamber 12, and communicating hole 14 to be each sectioned and formed.

Also, the ink supplying hole 22 is connected to the ink tank 301 (see FIG. 1) via the connecting pipe 23 and tube 306 (see FIG. 1). The ink supplied from the ink supplying hole 22 is supplied to the independent pressure chambers 6 via the ink supplying openings 8.

The glass substrate 4 joined to the lower side of the cavity plate 3 is a borosilicate glass substrate, which has a thermal expansion coefficient close to that of silicon. Within the glass substrate 4, recesses 42 comprising the vibrating chambers (sealed chambers) 41 are formed at the portion facing the vibrating plates 5. Individual electrodes 43 corresponding to the vibrating plates 5 are formed at the base planes of the recesses 42. The individual electrodes 43 have a segment electrode 44 formed of ITO (Indium Tin Oxide) and a terminal portion 45.

Also, in the glass substrate 4 a recess 46 of the same depth as the recess 42 is formed at the portion facing the displacement plate 16 comprising the base plate portion of the atmosphere communicating chamber 12. The recess 46 is connected to the recess 42 via the communicating recess 47. A dummy electrode 48 of ITO is formed in the recess 46 as well.

Joining the glass substrate 4 to the cavity plate 3 causes the vibrating plates 5 defining the base plane of the pressure chambers 6 and the segment electrode portions 44 of the individual electrodes 43 to face each other across an extremely narrow gap G. This gap G is sealed by a sealing agent 20 placed between the cavity plate 3 and the glass substrate 4, and a vibrating chamber 41 in a sealed state is thereby formed. Also, the recess 46 is covered by the displacement plate 16 which is the base plate portion of the atmosphere communicating chamber 12, thereby forming the pressure compensation chamber 49 for compensating pressure in the vibrating chambers 41 according to fluctuations in the external atmospheric pressure. The pressure compensating chamber 49 is in communication with the vibrating chambers 41 via the communicating portion 50 formed by the communicating recess 47.

The vibrating plate 5 is thin and is capable of elastic deformation in the direction outwards from the plane, in which it is formed i.e., the vertical direction in FIG. 3. The vibrating plate 5 functions as a common electrode for the side of the pressure chambers. Facing electrodes are formed by the vibrating plate 5 and corresponding segment electrodes 44 across the gap G.

A head driver 220 (FIG. 6), described below, is connected between the vibrating plate 5 and the individual electrodes 43. One output of the head driver 220 is connected to the terminals 45 of the individual electrodes 43, and the other output is connected to the common electrode terminal 26 formed at the cavity plate 3. The cavity plate itself has electroconductivity, so voltage can be supplied from the common electrode terminal 26 to the vibrating plate 5. Incidentally, in the event that there is a need to supply voltage to the vibrating plate 5 at a lower electrical resistance, a thin film of an electroconducting material such as gold or the like may be formed at one plane of the cavity plate 3 by vapor deposition, sputtering, or the like. With the present example, a positive pole joining is used for connecting the cavity plate 3 and the glass substrate 4, so an electroconductive film is formed on the side of the channel formation plane of the cavity plate 3. Also, the dummy electrodes 48 are for preventing the displacement plate 16 from adhering to the glass substrate side at the time of anodic bonding.

Pressure Compensating Operation

With the ink-jet head 1 of this configuration, applying a driving voltage across the opposing electrodes from the head driver 220 generates electrostatic force due to a charge that arises between the opposing electrodes, the vibrating plate 5 deforms toward the side of the segment electrode portion 44, and the volume of the pressure chamber 6 increases. Next, canceling the driving voltage from the head driver 220 between the opposing electrodes and discharging the charge therebetween causes the vibrating plate to return by the elastic restoring force thereof, and the volume of the pressure chamber 6 rapidly shrinks. Due to the internal pressure fluctuation generated at this time, a portion of ink stored in the pressure chamber 6 is discharged from the ink nozzle 21 communicating with the pressure chamber 6 so as to be discharged toward the recording paper.

Now, a case wherein the external atmospheric pressure changes will be described. For example, in the event that the device is moved from sea level to a high altitude, the external atmospheric pressure drops. In this case, unless the internal pressure of the vibrating chambers 41 also changes, the internal pressure becomes markedly greater than the external atmospheric pressure. Consequently, in order to obtain balanced pressure, the vibrating plate 5 of the vibrating chambers 41 deforms upwards in the view shown in FIG. 4, so that the volume of the vibrating chambers 41 is increased.

However, with the present example, the vibrating chambers 41 communicate with the pressure compensating chamber 49 via the communicating portion 50. This pressure compensating chamber 49 faces the atmosphere communicating chamber 12 that communicates with the atmosphere, across the displacement plate 16. The compliance of the displacement plate 16 is extremely great as compared to that of the vibrating plates 5. Accordingly, the displacement plate 16 is displaced upwards in the FIG. 4 view before the vibrating plates 5 are displaced, thereby increasing the volume of the pressure compensating chamber 49, and forming a balanced pressure state with the external atmospheric pressure. Accordingly, the gap between the vibrating plates 5 and individual electrode 43 is maintained at a constant value, regardless of fluctuations in external pressure.

As described above, with the ink-jet head 1 according to the present embodiment, even in the event that fluctuations in the external atmospheric pressure occur, there are essentially no adverse effects on the vibrating properties of the vibrating plates. Accordingly, constant and stable ink discharging properties can be maintained, regardless of fluctuations in the external atmospheric pressure.

Incidentally, with the ink-jet head according to the present example, the vibrating chamber 41 and pressure compensating chamber 49 are formed in the plane (horizontal) direction. That is, at the time of forming the recess 7 for the pressure chamber in the cavity plate 3, i.e., at the time of forming the vibrating plate 5, the displacement plate 16 is also formed to a thickness approximately the same as that of the vibrating plate 5. Accordingly, manufacturing of an ink-jet head having pressure compensating functions is simplified. Also, the displacement plate 16 is covered by the nozzle plate 2, having the advantage that this portion can be securely protected so that there is no damage thereto. Further, such a protecting portion uses a portion of the nozzle plate 2, having the advantage that manufacturing is simpler than in a case using a separate protective plate.

Control System

Figure 6:
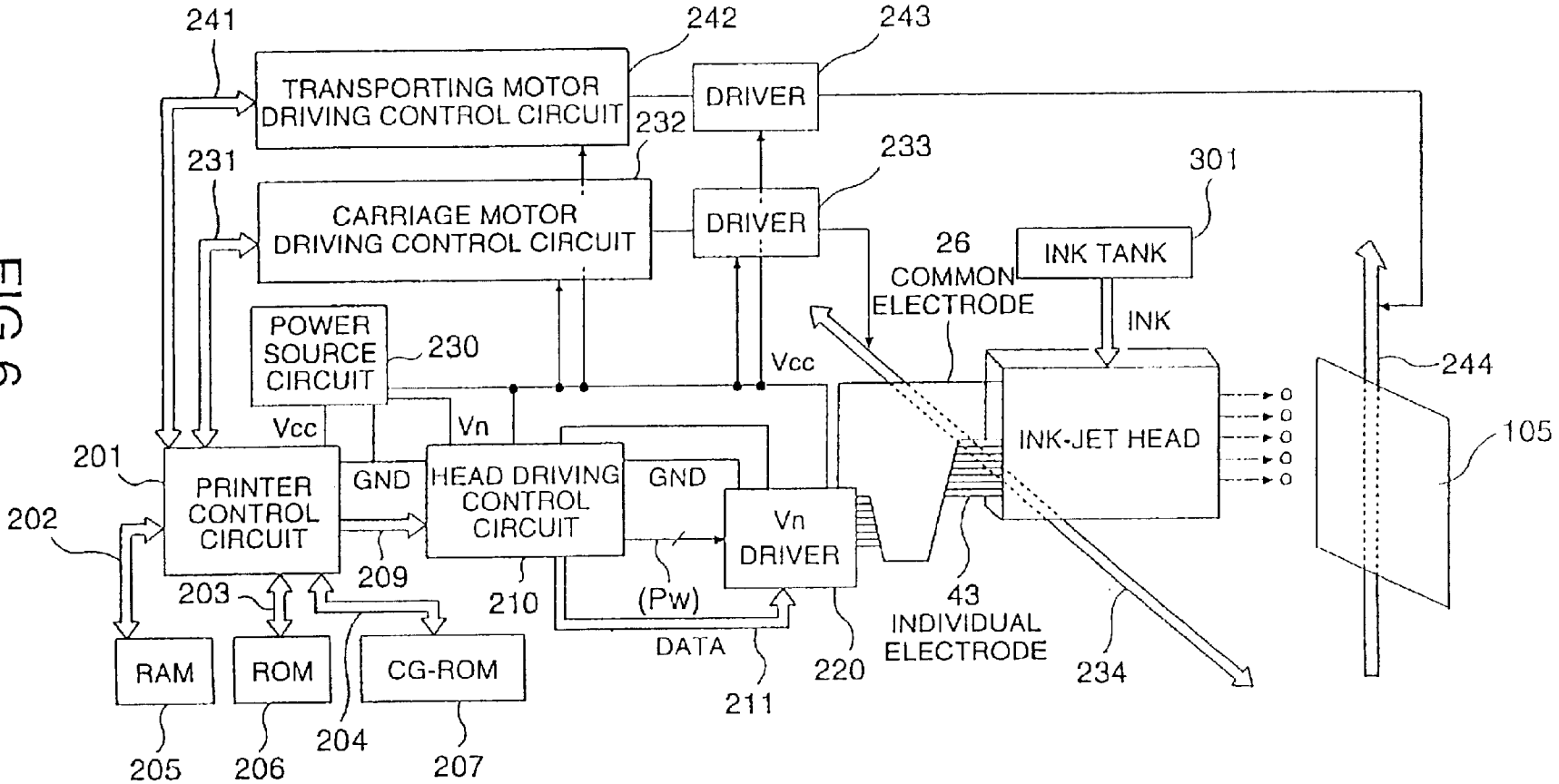
FIG. 6 is a schematic configuration diagram illustrating the control system of the ink-jet printer shown in FIG. 1.

FIG. 6 is a schematic configuration diagram of the control system of the ink-jet printer 400 according to the present embodiment. The circuitry comprising the center of this control system can be formed with a one-chip microcomputer, for example. Briefly describing the overview of the control system according to the present embodiment with reference to the Figures, reference numeral 201 denotes a printer control circuit, and RAM 205, ROM 206, and a character generator ROM (CG-ROM) 207 are connected to the printer control circuit 201 via internal busses 202, 203, and 204, including an address bus and data bus.

A control program is stored within the ROM 206, and the driving control action of the ink-jet head 1 is executed based on the control program called and activated therefrom. The RAM 205 is used as the work area for the driving control, and dot patterns corresponding to input characters are rendered in the CG-ROM 207.

Reference numeral 210 denotes a head driving control circuit, which outputs driving signals, clock signals, etc., to the head driver 220, under the control of the printer control circuit 201 which is connected via the internal bus 209. Also, printing data DATA is provided via the data bus 211.

The head driver 220 is comprised of a TTL array, for example, that generates driving voltage pulses corresponding to input driving signals, and applies these to the individual electrodes 43 and common electrode 26, which are the object of driving, to cause discharge of ink droplets from the corresponding ink nozzles 21. In order to generate the driving voltage pulses, a ground voltage GND, and driving voltages Vn, are supplied to the head driver 220. These voltages Vn are generated from the driving voltage Vcc of the power source circuit 230.

The carriage motor driving control circuit 232 is connected to the printer control circuit 201 via the internal bus 231. The carriage motor driving control circuit 232 drives the carriage motor (not shown) for reciprocally driving the carriage 302 bearing the ink-jet head 1 via the motor driver 233, so as to move the ink-jet head 1 in the direction shown by the arrow 234 in the Figure. Also, the transport motor driving control circuit 242 is connected to the printer control circuit 201 via the internal bus 241. The transport motor driving control circuit 242 drives the transport motor via the motor driver 243, and performs transport control of the recording paper 105 following the platen roller 300, in the transporting direction shown by the arrow 244 in the Figure.

Second Embodiment

As described next, the displacement plate 16 for pressure compensating in the above ink-jet head 1 may be formed in a curved plane form under standard external atmospheric pressure at sea level, instead of a flat plate form.

Figure 7:
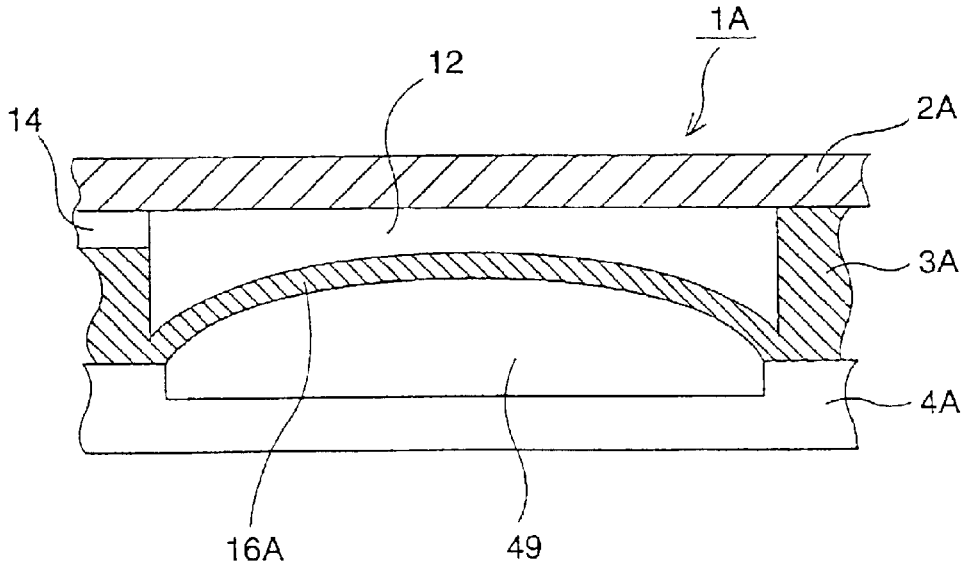
FIG. 7 is a schematic partial cross-sectional diagram illustrating the principal portions of the pressure compensator of the ink-jet head relating to a second embodiment of the present invention.

FIG. 7 is a partial cross-sectional diagram of an ink-jet head 1A having the displacement plate 16A in a curved form that bends toward and protrudes into the side of the atmosphere pressure chamber 12. The members other than this displacement plate 16A are the same as those in the ink-jet head 1 shown in FIG. 2 through FIG. 5.

The displacement plate 16A in such form can be manufactured as follows. A boron-doped layer of silicon is formed by doping with boron the portion of the cavity plate 3 that will form the displacement plate 16A, before etching the cavity plate 3. The boron-doped layer is etched at the same time as the etching to form the vibrating plates 5, thereby forming the displacement plate 16A.

Boron is diffused in the boron-doped layer portion, and thus is expanded as compared with other silicon portions. Further, the expansion of the portion where the boron-doped layer is formed is restricted by the silicon portions at both sides thereof which have not been doped with boron. Accordingly, forming a thin displacement plate 16A at the boron-doped layer portion causes the displacement plate 16A to be a curved form that is bent to protrude in the outer direction, or in a recessed form.

A glass substrate 4A is positive-pole-joined to the lower side of the cavity plate 3A to which the displacement plate 16A is formed, and a sealed pressure compensating chamber 49 is sectioned and formed by the displacement plate 16A and the opposing glass substrate portion. The opposite side of the displacement plate 16A faces the atmosphere pressure chamber 12. Accordingly, as shown in FIG. 7, the displacement plate 16A bends in a protruding curved plane form toward the side of the atmosphere pressure chamber 12.

With the ink-jet head 1A having the displacement plate 16A bent in a protruding curved plane form toward the side of the atmosphere pressure chamber 12 as described above, in the event that the external atmospheric pressure is high, the displacement plate 16A is pressed toward the side of the pressure compensating chamber 49 and deforms. Accordingly, the atmospheric pressure fluctuations can more effectively compensated for in the event that the external atmospheric pressure is high, as compared with the flat displacement plate 16.

However, such a displacement plate 16A which protrudes toward the side of the atmosphere pressure must bend even further in the protruding direction in the event that the external atmospheric pressure is lower than the internal pressure of the pressure compensating chamber 49 (the atmospheric pressure at the time of sealing this chamber 49), so the compliance drops. Accordingly, the pressure compensating functions thereof may not be sufficiently exhibited.

Figure 8:
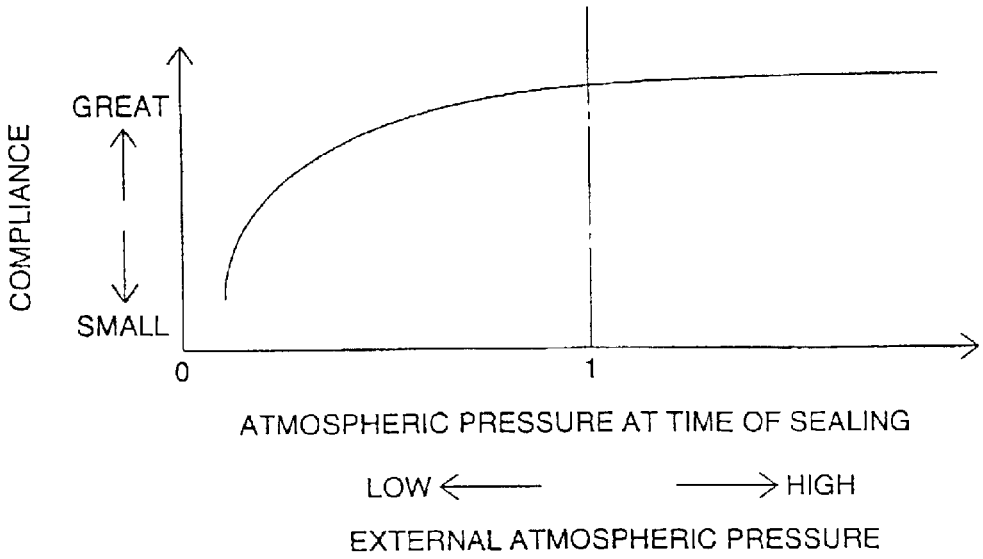
FIG. 8 is a graph illustrating the compliance properties of the displacement plate of the ink-jet head shown in FIG. 7.

FIG. 8 is a graph illustrating a properties curve qualitatively illustrating the degree of compliance of the displacement plate 16A. as a function of the external atmospheric pressure. In this graph, the horizontal axis indicates external atmospheric pressure, and the vertical axis indicates compliance. As can be understood from this graph, the lower the external atmospheric pressure compared to the air pressure at the time of sealing the pressure compensating chamber 49, the lower the compliance of the displacement plate 16A, and this rapidly deteriorates in a non-linear form. That is, displacement plate 16A does not bend as readily, and accordingly, the pressure compensating functions thereof rapidly deteriorate.

In the event that the external atmospheric pressure is low, in order to sufficiently raise the compliance of the displacement plate 16A so as to be sufficiently high even at high elevations for example, the pressure compensating chamber 49 is preferably sealed at reduced pressure. For example, the pressure compensating chamber 49 is preferably sealed at a reduced pressure state of around 650 hPa±50 hPa absolute pressure.

Figure 9:
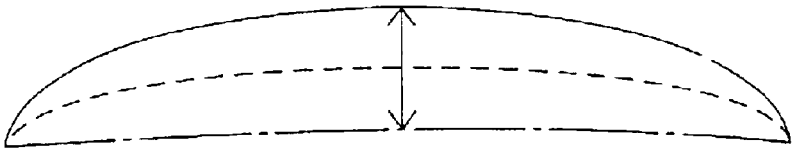
FIG. 9 is an explanatory diagram illustrating the behavior of the displacement plate of the ink-jet head shown in FIG. 7.

FIG. 9 is an explanatory diagram illustrating the behavior of the displacement plate 16A sealed at a reduced pressure. In the Figure, the solid line represents the state of the displacement plate 16A before air-tight sealing, the dotted line represents the state of the displacement plate 16A after reduced-pressure sealing, and the broken line represents the state of the displacement plate 16A in the event that the external atmospheric pressure is high.

Thus, even in the event that the external atmospheric pressure is high, the displacement plate 16A does not come into contact with the base plane of the pressure compensating chamber 49 (the surface of the dummy electrode 48) and stop functioning. Also, as can be understood from the graph in FIG. 8, the relationship of compliance of the displacement plate 16A to fluctuations in the external atmospheric pressure remains almost linear, so compensation according to fluctuations in the external atmospheric pressure can be performed properly.

Third Embodiment

Figure 10:
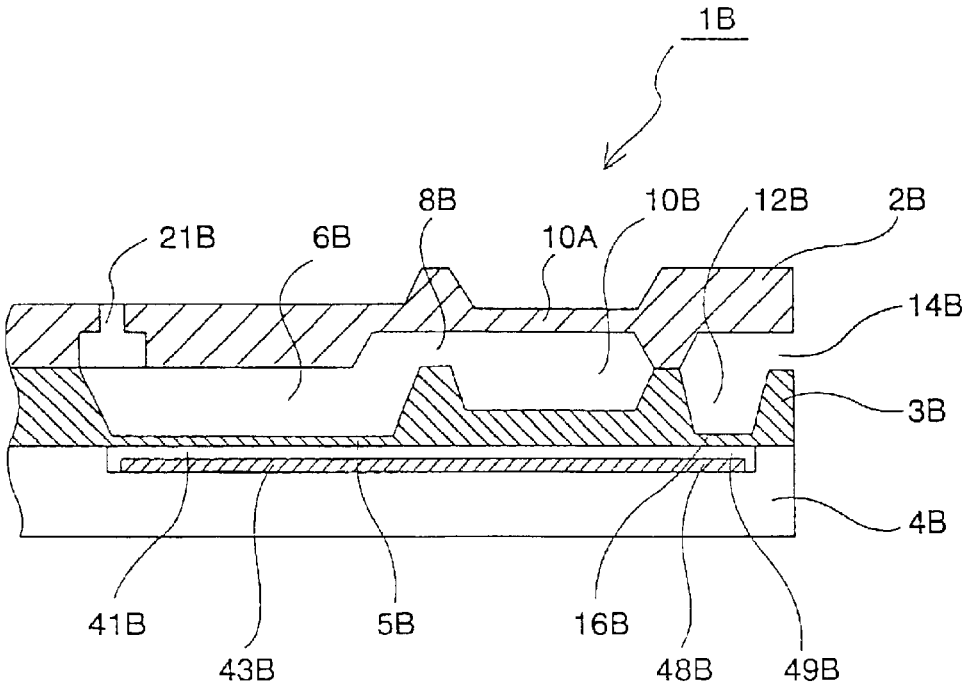
FIG. 10 is a schematic partial cross-sectional diagram illustrating the principal portions of the ink-jet head relating to a third embodiment of the present invention.
Figure 11:
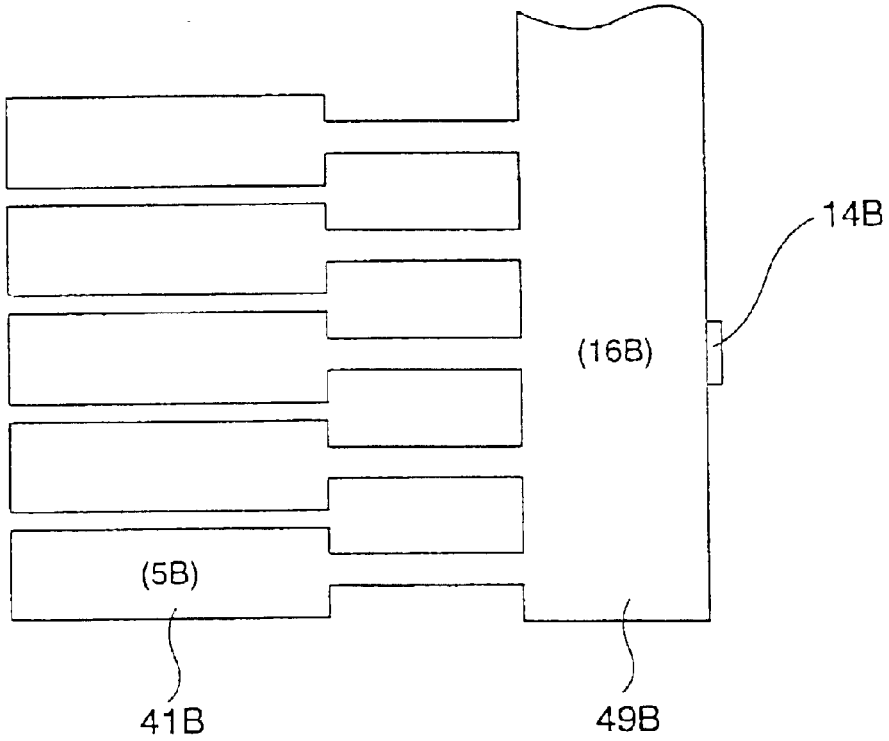
FIG. 11 is an explanatory diagram illustrating the placement of the vibrating chamber relative to the pressure compensating chamber of the ink-jet head shown in FIG. 10.

FIG. 10 is a schematic cross-sectional diagram illustrating a third embodiment of the ink-jet head to which the present invention is applied, and FIG. 11 is an explanatory diagram illustrating the placement of the vibrating chamber relative to the pressure compensating chamber. The basic structure of the ink-jet head 1B according to the present embodiment is the same as that of the above-described ink-jet heads 1 and 1A, with a structure having a nozzle plate 2B and glass substrate 4B layered above and below with a cavity plate 3B therebetween.

A pressure chamber 6B communicating with the ink nozzle 21B, and a common ink chamber 10B communicating with the pressure chambers 6B via the ink supplying chamber 8B, are sectioned and formed between the nozzle plate 2B and the cavity plate 3B. Also, the atmospheric pressure or atmosphere communicating chamber 12B is sectioned and formed at a position neighboring the common ink chamber 10B, and this atmospheric pressure chamber 12B communicates with the atmosphere via the atmosphere communicating hole 14B.

A thin displacement plate 16B is formed at the base plane portion of the atmosphere pressure chamber 12B, and vibrating plates 5B are also formed at the base plane portions of the pressure chambers 6B, as well. A vibrating chamber 41B having a gap for displacing the vibrating plate 5B, and a pressure compensating chamber 49B having a gap for displacing the displacement plate 16B are sectioned and formed between the lower plane of the cavity plate 3B and the glass substrate 5B. The pressure compensating chamber 49B communicates with the vibrating chambers 41B. Individual electrodes 43B are formed of ITO in the base plane of the vibrating chambers 41B, and a dummy electrode 48B is formed of ITO in the base plane of the pressure compensating chamber 49B.

The portion of the nozzle plate 2B forming the common ink chamber 10B is a displacement plate 10*a* capable of being displaced in the direction outwards from the horizontal plane. This displacement plate 10*a* is for preventing pressure fluctuations in the pressure chambers 6B from carrying over to the neighboring pressure chambers 6B via the common ink chamber 10B, and is displaced by elasticity in the direction outwards from the horizontal plane, according to pressure fluctuations.

With the ink-jet head 1B according to the present embodiment as well, the displacement plate 16B sectioning the pressure compensating chamber 49B is displaced according to fluctuations in external atmospheric pressure. Accordingly, the vibrating plates 5B are prevented from being displaced according to fluctuations in external atmospheric pressure, so that stable ink ejecting properties can be maintained.

Figure 12:
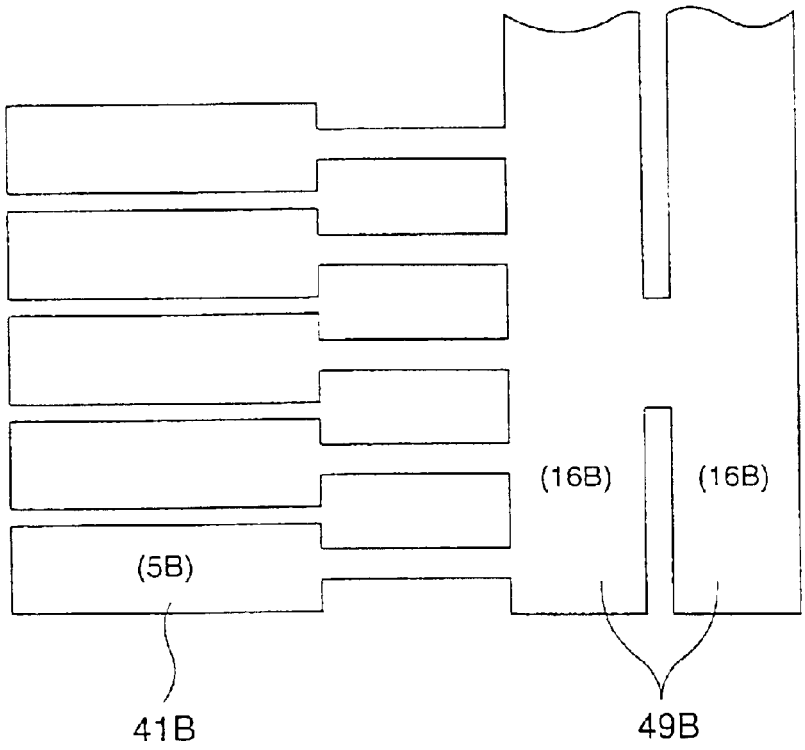
FIG. 12 is an explanatory diagram illustrating another example of the placement of the vibrating chamber relative to the pressure compensating chamber.

A configuration employing a plurality of atmosphere pressure chambers 12B and pressure compensating chambers 49B may be used. FIG. 12 shows an example wherein two atmospheric pressure chambers and two corresponding pressure compensating chambers are used, wherein two displacement plates are positioned accordingly.

Figure 13:
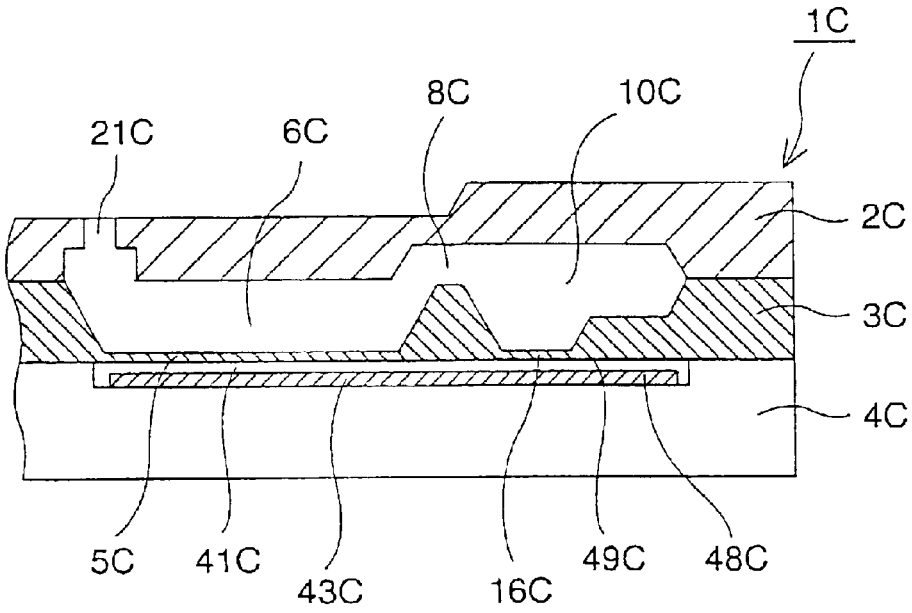
FIG. 13 is a schematic partial cross-sectional diagram illustrating an improved embodiment of the ink-jet head shown in FIG. 10.

FIG. 13 illustrates an improved embodiment of the ink-jet head 1B. With this ink-jet head 1C as well, a nozzle plate 2C and glass substrate 4C are layered above and below with a cavity plate 3C therebetween. An ink nozzle 21C is formed in the nozzle plate 2C. A pressure chamber 6C communicating with the nozzle 21C, and a common ink chamber 10B communicating with the pressure chambers 6C via the ink supplying chamber 8C are sectioned and formed between the nozzle plate 2C and the cavity plate 3C.

Vibrating plates 5C are also formed at the base plane portions of the pressure chambers 6C. Also, a displacement plate 16C, having a compliance far greater than that of the vibrating plates 5C, is provided on the base plane portion of the common ink chamber 10C. A vibrating chamber 41C having a gap provided for displacement of the vibrating plate 5C, and a pressure compensating chamber 49C having a gap provided for displacement of the displacement plate 16C are sectioned and formed between the lower plane of the cavity plate 3C and the glass substrate 4C. The pressure compensating chamber 49C communicates with the vibrating chambers 41C. Individual electrodes 43C are formed of ITO in the base plane of the vibrating chambers 41C, and a dummy electrode 48C is formed of ITO in the base plane of the pressure compensating chamber 49C.

With the ink-jet head 1C according to the present example, a displacement plate 16C is formed on the base plane portion of the common ink chamber 10C. Accordingly, the displacement plate 16C functions as both the displacement plate 16B and the displacement plate 10*a* of the above-described ink-jet head 1B. That is, this displacement plate 16C prevents pressure fluctuations in the pressure chambers 6C from carrying over to the neighboring pressure chambers 6C via the common ink chamber 10C. Also, the vibrating plates 5C are prevented from being displaced according to fluctuations in external atmospheric pressure, so that stable ink ejecting properties can be maintained.

The ink-jet head IC according to the present embodiment can be formed in a more compact manner than the above-described ink-jet head 1B. That is, there is no need to provide a separate atmospheric pressure chamber, and the initial atmospheric fluctuation compensation and internal pressure fluctuations within the common ink chamber are absorbed by the single displacement plate 16C.

Fourth Embodiment

Figure 14A:
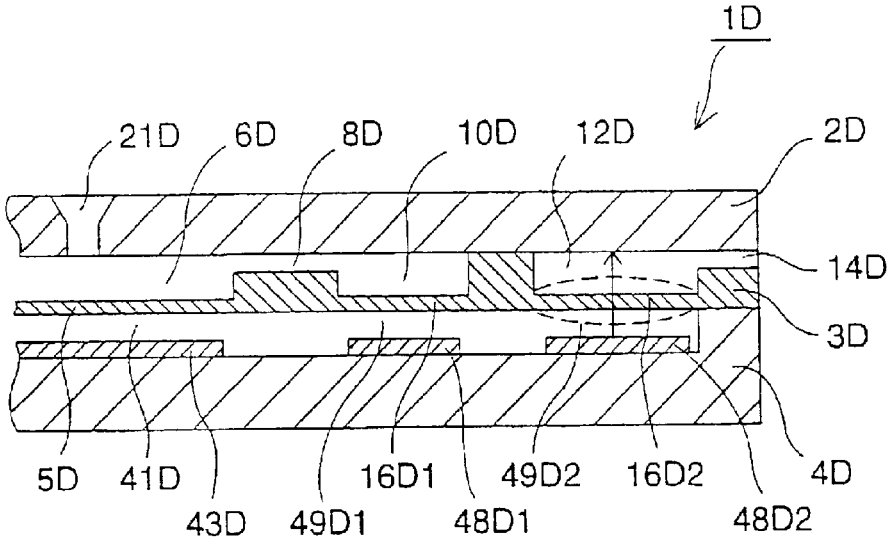
FIG. 14(A) is a schematic partial cross-sectional diagram relating to a fourth embodiment of the ink-jet head of the present invention.
Figure 14B:
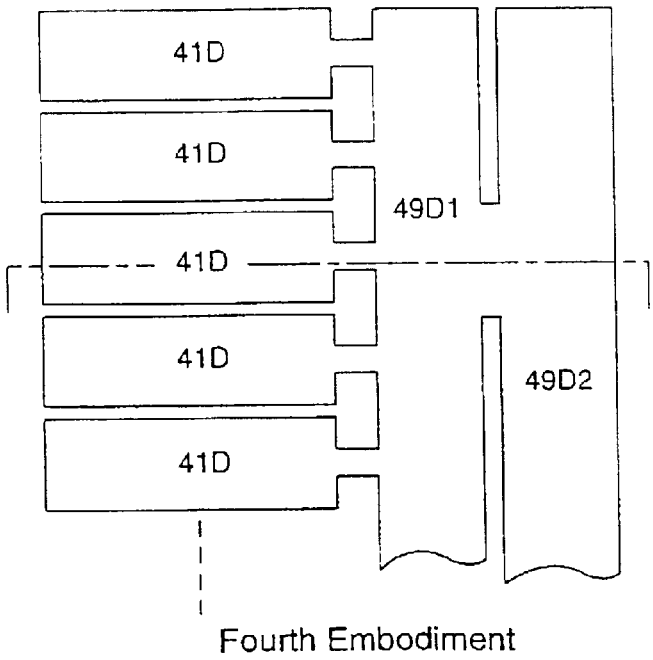
FIG. 14(B) is an explanatory diagram illustrating the placement of the vibrating chamber relative to the pressure compensating chamber.

FIG. 14(A) is a partial cross-sectional diagram illustrating a fourth embodiment of the ink-jet head to which the present invention is applied, and FIG. 14(B) is an explanatory diagram illustrating the placement of the vibrating chamber relative to the pressure compensating chamber. This ink-jet head ID is also configured with a nozzle plate 2D and glass substrate 4D being layered above and below with a cavity plate 3D therebetween. An ink nozzle 21D is formed in the nozzle plate 2D. A pressure chamber 6D communicating with the nozzle 21D, a common ink chamber 10D communicating with the pressure chambers 6D via the ink supplying chamber 8D, and an atmospheric pressure chamber 12D communicating with the atmosphere, are sectioned and formed between the nozzle plate 2D and the cavity plate 3D. Vibrating plates 5D are formed on the base plane portions of the pressure chambers 6D. Also, a displacement plate 16D1 is formed on the base plane portion of the common ink chamber 10D. In the same way, a displacement plate 16D2 is formed on the base plane portion of the atmosphere pressure chamber 12D.

A vibrating chamber 41D having a gap provided for displacement of the vibrating plate 5C, and a first pressure compensating chamber 49D1 having a gap provided for displacement of the displacement plate 16D1, and a second pressure compensating chamber 49D2 having a gap provided for displacement of the displacement plate 16D2, are sectioned and formed between the lower plane of the cavity plate 3D and the glass substrate 4D. The pressure compensating chamber 49D1 communicates with the vibrating chambers 41D, and the pressure compensating chamber 49D2 communicates with the pressure compensating chamber 49D1.

Individual electrodes 43D are formed of ITO on the base plane of the vibrating chambers 41D, and electrodes 48D1 and 48D2 are formed of ITO on the base plane of the pressure compensating chambers 49D1 and D2, respectively.

Figure 15A:
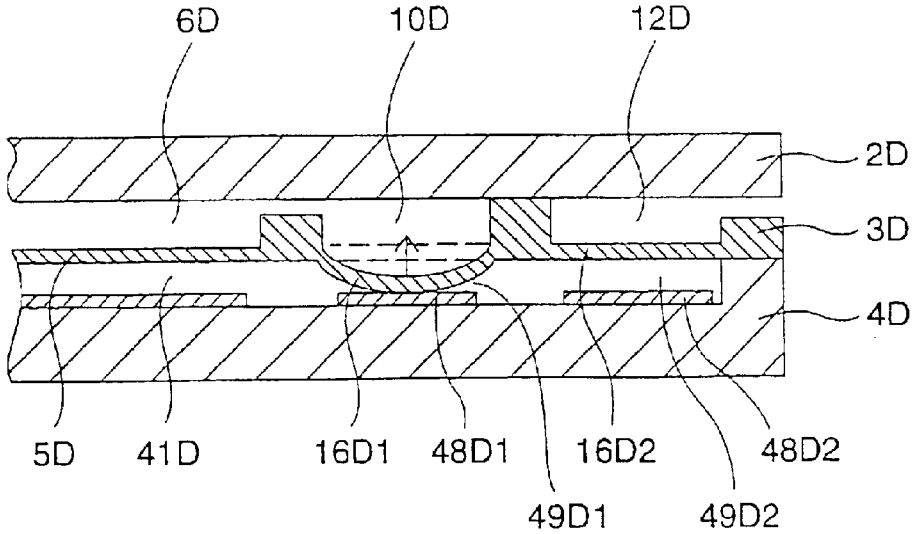
FIGS. 15(A) and (B) are explanatory diagrams illustrating the pressure compensation action of the ink-jet head shown in FIG. 14.

As shown in FIG. 15(A), applying voltage across the displacement plate 16D1 and the electrode 48D1 generates an electrostatic attractive force, whereby the displacement plate 16D1 is drawn toward the electrode side and is deformed. Consequently, the volume of the first pressure compensating chamber 49D1 is reduced, and the internal pressure of the communicating vibrating chamber 41D is increased. Stopping application of the voltage causes elastic restoration of the displacement plate 16D1, so the internal pressure of the communicating vibrating chamber 41D returns to its original state.

Figure 15B:
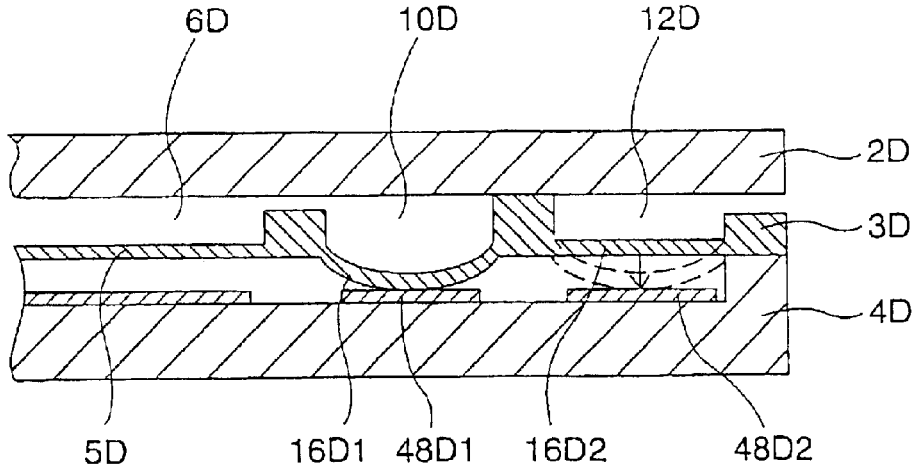

For example, in the event that the ambient atmospheric pressure is a certain value, voltage is applied between the displacement plate 16D1 and the electrode 48D1 so that the displacement plate 16D1 is drawn toward the electrode 48D1, as shown in FIG. 15(B). In the event that the external atmospheric pressure drops, lowering the applied voltage or stopping the voltage application causes the internal pressure of the vibrating chambers 41D to drop, so the pressure difference between the vibrating chambers 41D and the external atmospheric pressure decreases. Accordingly, the vibrating properties of the vibrating plates 5D can be held constant, and change in the ink discharge properties can be suppressed.

On the other hand, in the event that the external atmospheric pressure increases, raising the applied voltage causes the deformation of the displacement plate 16D1 to increase, and the pressure in the vibrating chambers 41D is raised, so the pressure difference with the external atmospheric pressure is reduced, and a change in the ink discharge properties can be avoided in this case, as well.

Now, in the event that the amount of change in the external atmospheric pressure is great, a volume change in the second pressure compensation chamber 49D2 can be used as follows. In the event that the ambient atmospheric pressure is a certain value, voltage is applied between the displacement plate 16D1 and the electrode 48D1 so that the displacement plate 16D1 is drawn toward the electrode 48D1, as shown in FIG. 15(A). In the event that the external atmospheric pressure rises, voltage is applied across the second displacement plate 16D2 and the electrode 48D2 so that the displacement plate 16D2 is also deformed. Consequently, the capacity of the second pressure compensating chamber 49D2 also is reduced, so the pressure of the vibrating chambers 41D can be greatly increased to match the rise in external atmospheric pressure. Accordingly, the pressure difference between external atmospheric pressure which has risen greatly and the internal pressure of the vibrating chambers can be reduced or eliminated.

Conversely, in the event that the external atmospheric pressure drops, application of voltage is stopped, so that the first displacement plate 16D1 returns to its original state, thereby increasing the volume of the first pressure compensating chamber 49D1. Accordingly, the internal pressure of the vibrating chambers 41D drops, and the pressure difference between external atmospheric pressure and the internal pressure is reduced or eliminated. The voltage application control for the electrodes 48D1 and 48D2 for increasing or decreasing the volume of the first and second pressure compensating chamber 49D1 and 49D2 can be performed by a control mechanism described as follows.

Figure 16:
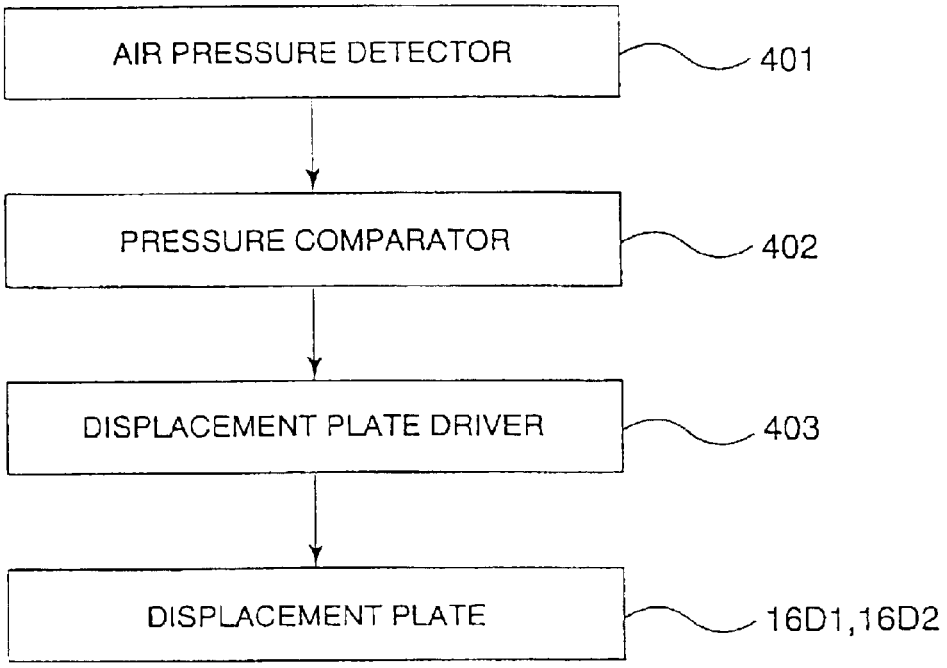
FIG. 16 is a schematic configuration diagram illustrating the driving control mechanism of the displacement plate of the ink-jet head shown in FIG. 14.

That is, as shown in FIG. 16, external atmospheric pressure is detected by air pressure detector 401, the set air pressure is compared with the detected external atmospheric pressure by pressure comparator 402, and the displacement plates 16D1 and 16D2 are displaced with displacement plate driver 403, based on the comparison results.

Incidentally, various sensors can be used for the air pressure detector, such as electrostatic capacity air pressure sensors, piezoelectric air pressure sensors, and so forth. Also, the attachment position of the air pressure detector is not restricted to being near the ink-jet head 1D, but rather may be at any position where similar air pressure measurement can be performed.

Also, the external atmospheric pressure may be calculated by detecting the electrical capacity between the displacement plate and the electrode.

Fifth Embodiment

Figure 17:
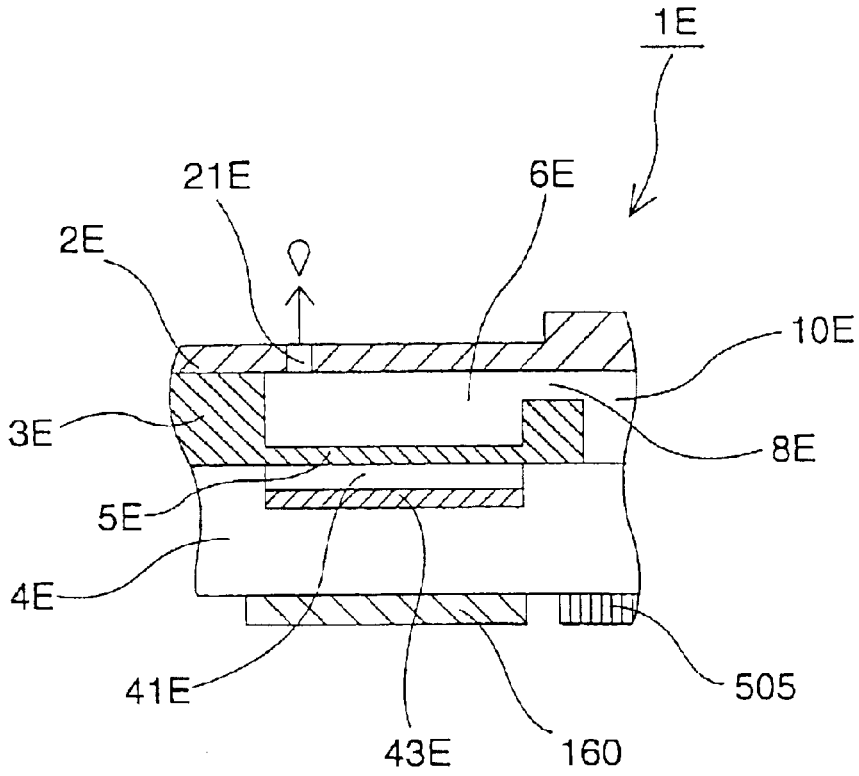
FIG. 17 is a schematic partial cross-sectional diagram illustrating the principal portions of the ink-jet head relating to a fifth embodiment of the present invention.

FIG. 17 is a partial configuration diagram illustrating the principal components of the fifth embodiment of the ink-jet head in which the present invention is applied. The basic structure of the ink-jet head 1E according to the present embodiment is the same as that of the above-described embodiments, with a nozzle plate 2E and glass substrate 4E being layered above and below with a cavity plate 3E therebetween. An ink nozzle 21E is formed in the nozzle plate 2E. A pressure chamber 6E communicating with the nozzle 21E and a common ink chamber 10E communicating with the pressure chambers 6E via the ink supplying chamber 8E are sectioned and formed between the nozzle plate 2E and the cavity plate 3E. Vibrating plates 5E are formed at the base plane portions of the pressure chambers 6E.

A vibrating chamber 41E having a gap for allowing displacement of the vibrating plate 5E is sectioned and formed between the lower plane of the cavity plate 3E and the glass substrate 4E. Individual electrodes 43E are formed of ITO in the base plane of the vibrating chambers 41E.

The present embodiment is characterized in that instead of providing a pressure compensating chamber wherein the volume fluctuates according to a displacement plate of the pressure compensator, a heat controlling member 160 is used to heat or cool a sealed gas in the vibrating chambers 41E, thereby increasing or reducing the internal pressure of the vibrating chambers 41E, and consequently reducing or eliminating the pressure difference between the vibrating chambers 41 and; the external atmospheric pressure.

As is known from Boyle-Charles' law, air pressure can be controlled by heat. For example, in the event that the external atmospheric pressure increases, the heat controlling member 160 is activated to generate heat, and heating the vibrating chamber formation portion of the glass substrate 4E heats the gas within the vibrating chamber and the gas attempts to expand. However, the vibrating chamber 41E is sealed, so the internal pressure increases, and the pressure difference with the external atmospheric pressure is relieved.

Conversely, in the event that the external atmospheric pressure drops, the heat controlling member 160 performs an endothermic or cooling action, thereby cooling the glass substrate 4E, which cools the gas within the vibrating chamber, thus lowering the internal pressure. Accordingly, the pressure difference with the external atmospheric pressure can be relieved.

The heat controlling member may be a heat-generating member such as a tantalum nitride thin film, for example. Alternatively, this may be capable of endothermic action, such as a Peltier device.

Figure 18:
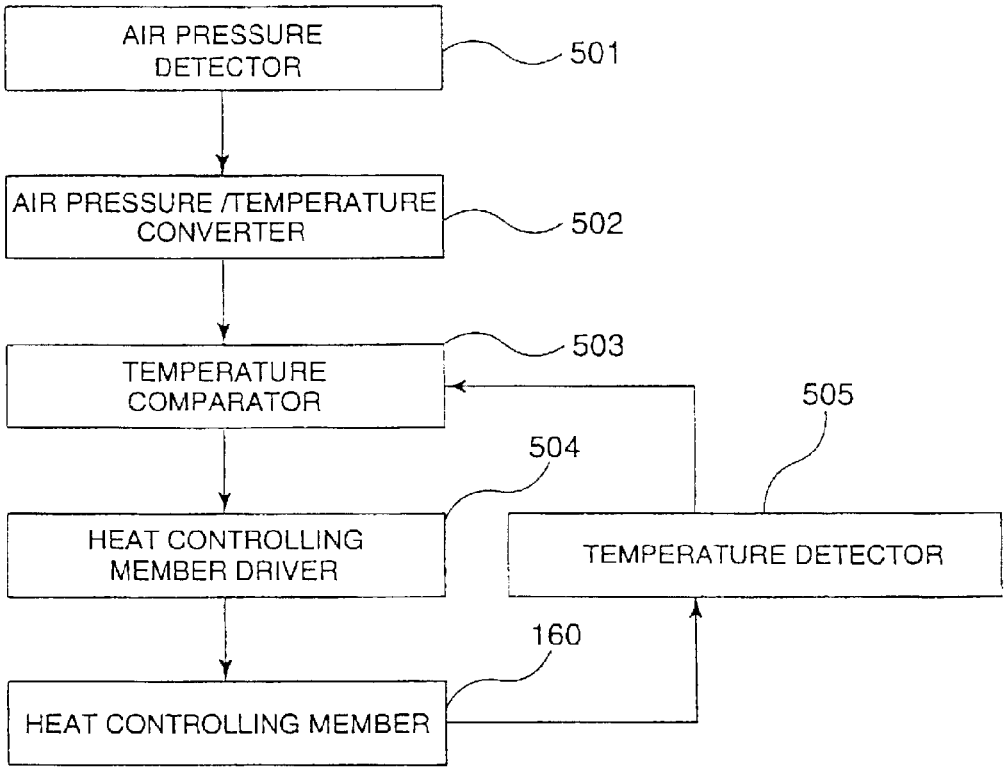
FIG. 18 is a schematic configuration diagram of the control mechanism of the heat control member in the ink-jet head shown in FIG. 17.

FIG. 18 is a schematic diagram of the driving control mechanism of the heat controlling member. As shown in the Figure, the air pressure detector 501 detects the external atmospheric pressure. The detected external atmospheric pressure is converted into the internal temperature of the vibrating chamber 41E, in the air pressure/temperature converter 502. The converted temperature is compared with a preset target temperature in the temperature comparator 503. The heat controlling member driver 504 drives the heat controlling member 160 based on the comparison results, such that the temperature within the vibrating chamber meets the target temperature.

Temperature detector 505 may be attached to the glass substrate 4E (see FIG. 17), comparing the detected value with the target temperature in order to execute even more precise temperature management.

Also, detection of the air pressure may be calculating based on the electrical capacity between the vibrating plate 5E and electrode 43E in the vibrating chamber 41E, instead of mounting an air pressure sensor or the like on the ink-jet printer.

Figure 19:
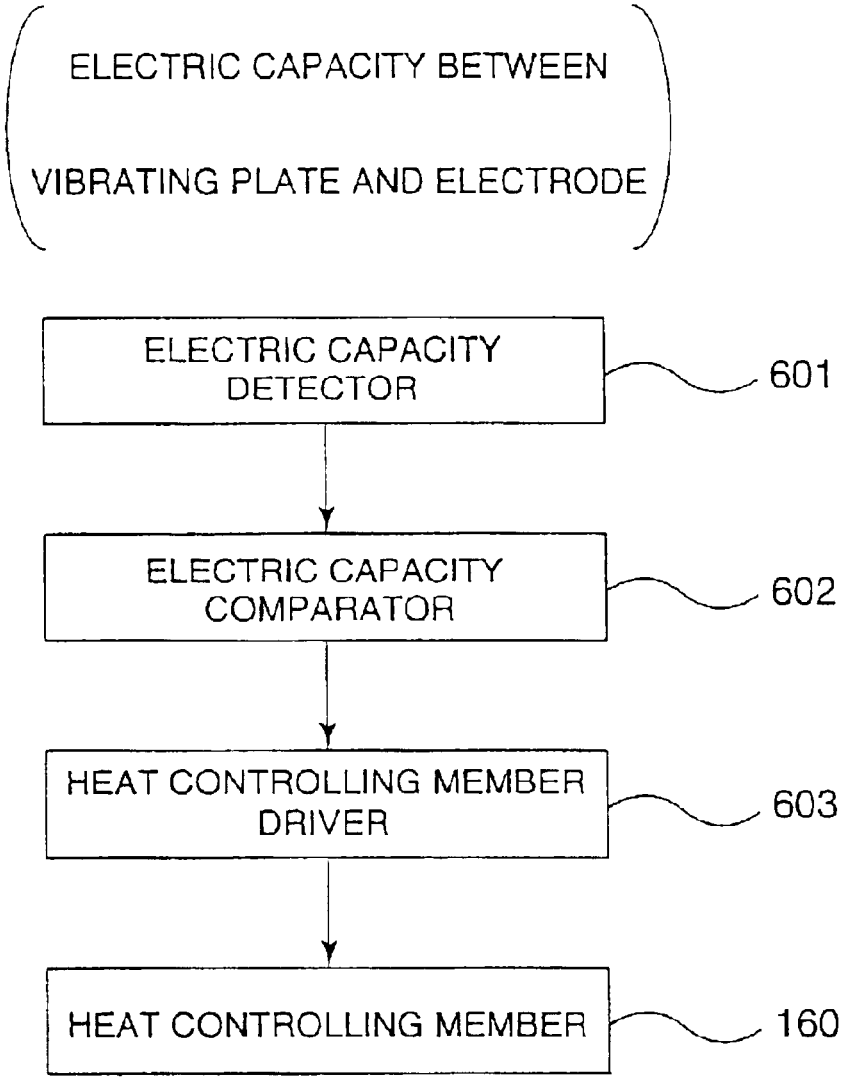
FIG. 19 is a schematic configuration diagram illustrating another example of the control mechanism of the heat control member in the ink-jet head shown in FIG. 17.

In this case, as shown in FIG. 19, the electrical capacity between the vibrating plate and electrode is detected by electrical capacity detector 601, and the detected electrical capacity is compared with a preset target value by the comparator 602, so that the heat generating member can be driven and controlled by the heat controlling member driver 603, based on the comparison results.

Other Embodiments

Figure 20:
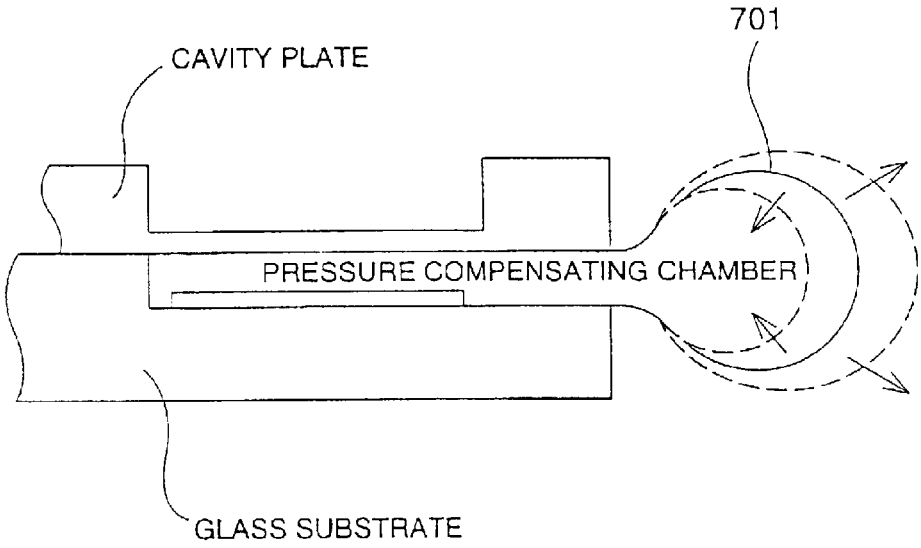
FIG. 20 is an explanatory diagram illustrating another example of the ink-jet head according to the present invention.

With the above-described embodiments, a displacement plate is formed on one portion of the pressure compensating chamber, so that the volume of the pressure compensating chamber increases or decreases by the displacement plate being displaced according to fluctuations in the external atmospheric pressure. Instead of this, an arrangement may be used wherein the entire pressure compensating chamber 701 is formed of an elastic material, as shown in FIG. 20, so that the entirety thereof expands or contracts according to fluctuations in the external atmospheric pressure.

Industrial Applicability

As described above, the electrostatic actuator according to the present invention has a pressure compensator for reducing or eliminating the pressure difference between the internal pressure of vibrating chambers partitioned by vibrating plates and the external atmospheric pressure, so the vibrating properties of the vibrating plate do not change according to fluctuations in the external atmospheric pressure. Accordingly, a liquid discharging device in which the present invention is applied is capable of continually performing stable droplet discharging action, regardless of fluctuations in the external atmospheric pressure. For example, an ink jet printer using the present invention is capable of continuously performing high-quality image formation, regardless of where it is used, whether at high elevations or at sea level, etc.

What is claimed is:

1. A method for manufacturing an electrostatic actuator comprising a vibrating plate, an electrode plate facing said vibrating plate, and a vibrating chamber formed between said electrode plate and said vibrating plate, wherein said vibrating plate is displaced by electrostatic force, by applying voltage between said vibrating plate and said electrode plate, said method comprising:

a process for forming a pressure compensating chamber communicating with said vibrating chamber;

a process for forming a displacement plate at a portion of said pressure compensating chamber, displaceable according to external atmospheric pressure, into a warped form curved so as to protrude in a direction away from the facing inner wall of said pressure compensating chamber; and a process for shutting off and sealing said pressure compensating chamber and said vibrating chamber from the external atmosphere.

2. A method for manufacturing an electrostatic actuator according to claim 1, wherein said displacement plate is formed of a boron-doped layer formed by doping said semiconductor substrate.

3. A method for manufacturing an electrostatic actuator according to claim 1, further comprising a process for adjusting air pressure for sealing said pressure compensating chamber.

4. A method of manufacturing an electrostatic actuator comprising a vibrating plate, an electrode plate facing said vibrating plate, and a vibrating chamber formed between said electrode plate and said vibrating plate, wherein said vibrating plate is displaced through electrostatic force resulting from application of voltage across said vibrating plate and said electrode plate, said method comprising:

forming a pressure compensating chamber in communication with said vibrating chamber;

forming a curved displacement plate as part of said pressure compensating chamber such that said displacement plate protrudes in a direction away from a facing inner wall of said pressure compensating chamber, said displacement plate being displaceable according to external atmospheric pressure; and shutting off and sealing said pressure compensating chamber and said vibrating chamber from external atmosphere.

5. A method of manufacturing an electrostatic actuator according to claim 4, comprising doping a semiconductor substrate with boron to form said displacement plate as a boron-doped layer of said semiconductor substrate.

6. A method of manufacturing an electrostatic actuator according to claim 4 comprising adjusting the air pressure in said pressure compensating chamber prior to said step of sealing.

* * * * *